US006206752B1

(12) United States Patent
Fagin et al.

(10) Patent No.: US 6,206,752 B1
(45) Date of Patent: Mar. 27, 2001

(54) INVISIBLE STRAPS FOR APPAREL AND METHOD OF USE

(76) Inventors: Matthew Jeremy Fagin, 4140 Central Sarasota Pkwy., Apt. #1222; Rosanna Fagin, 4140 Central Sarasota Pkwy. #1222, both of Sarasota, FL (US) 34238

( * ) Notice: Subject to any disclaimer, the term of this patent is extended or adjusted under 35 U.S.C. 154(b) by 0 days.

(21) Appl. No.: 09/490,411

(22) Filed: Jan. 24, 2000

(51) Int. Cl.[7] ..... A41C 3/00

(52) U.S. Cl. ..... 450/1; 450/17; 450/88; 450/86; 2/78.1

(58) Field of Search ..... 450/1, 86, 88, 450/17, 30, 31, 32; 2/105, 106, 113–115, 69, 78.1, 80, 83

(56) References Cited

U.S. PATENT DOCUMENTS

| | | | | |
|---|---|---|---|---|
| 2,849,723 | * | 9/1958 | Marino | 450/88 |
| 3,311,112 | * | 3/1967 | Murray | 450/88 |
| 3,860,046 | | 1/1975 | Goff, Jr. . | |

* cited by examiner

*Primary Examiner*—Gloria M. Hale

(74) *Attorney, Agent, or Firm*—Dorothy S. Morse

(57) ABSTRACT

Non-woven, non-shiny, and substantially transparent clothing straps and a method for their use with apparel worn under loosely fitting sleeveless outer garments, undergarments used with sheer outer clothing or outer clothing having narrow shoulder straps or cutouts therein which would otherwise readily reveal undergarment straps, and other apparel to give a strapless illusion to it. The straps are made from flexible, resilient, but non-stretchable material and could be permanently attached to a garment or made to be easily and readily detached from it. In the most preferred present invention embodiment the straps would be made from a substantially non-stretchable polyurethane material. Optionally, even though the strap material itself would resist longitudinal folding, a short stretchable extension could be inserted between one end of the strap and the garment to which it is attached to help the strap resist twisting and lay in an essentially flat, more comfortable and discrete position during use. In permanently attached embodiments a strip of seam binding or other similarly biased material can also be stitched over the ends of the strap and the garment to which they are connected to reinforce the connection therebetween, to improve its overall appearance, and help secure and maintain the strap in its usable position. Applications can include, but are not limited to use with bras, brassieres, bodysuits, slips, camisoles, nightgowns, swim suits, bikini tops, halter tops, tank tops, and formal wear.

16 Claims, 2 Drawing Sheets

INVISIBLE STRAPS FOR APPAREL AND METHOD OF USE

BACKGROUND—FIELD OF INVENTION

This invention relates to clothing straps, specifically to substantially transparent, nonwoven, and non-shiny clothing straps that are virtually invisible to a casual observer, and a method for their use with apparel worn under loosely fitting sleeveless outer garments, undergarments worn with apparel having narrow shoulder straps or cutouts therein that would otherwise readily reveal the undergarment straps, and other apparel to give it a strapless illusion. The straps of the present invention could be permanently attached to a garment or made to be easily and readily detachable from it, and although not limited thereto, in the most preferred embodiment of the present invention the straps would be made from resilient and flexible, but substantially non-stretchable, polyurethane material. Optionally, even though the material used for the strap of the present invention would itself be resilient and resist folding, a short stretchable extension could be inserted between one end of the strap and the garment to which it is attached to resist strap twisting and further help the strap lay in an essentially flat position against the shoulder of the person wearing it during use. In permanently attached embodiments a strip of seam binding or other similarly biased material could also be stitched over the ends of the straps and the upper edge of the garment to which they are connected to reinforce the connection therebetween, improve the overall appearance of the apparel, and help secure and maintain the straps in their flat, non-twisted usable positions so that during use they remain virtually invisible. Applications may include, but are not limited to bras, brassieres, slips, bodysuits, camisoles, nightgowns, swim suits, bikini tops, halter tops, tank tops, and formal wear.

BACKGROUND—DESCRIPTION OF PRIOR ART

Fashion trends continually change. In women's clothing, hemlines, necklines, and sleeve lengths can vary dramatically from one year to the next. One currently popular item of apparel for women is a tightly fitting casual top for use with shorts, short skirts, and pants that extends approximately to the waist and has very narrow shoulder straps. Many wear such tops without an undergarment, however, some women are more comfortable wearing an undergarment or need one for support. When an undergarment such as a brassiere or camisole is worn under a top having very narrow shoulder straps, even though the straps of the undergarment may to a large extent remain hidden while the person wearing them is substantially inactive, the undergarment straps almost always are revealed with increased levels of user activity. If the color of the undergarment and the outer garment are similar, the straps of the undergarment may not be readily distinguishable from the shoulder straps of the top worn over it. However, when the colors of the two sets of straps are even slightly dissimilar, the straps of the undergarment become readily apparent. While exposure of undergarment straps is of no concern to many, others consider such exposure unsightly and in poor taste and would be uncomfortable if their own undergarment straps became exposed. For those considering the exposure of undergarment straps to be in poor taste or otherwise detracting from a desired fashion look desired, undergarments having the non-shiny, transparent, and substantially invisible straps of the present invention would allow those wanting to keep in step with the fashion trends to wear tops with very narrow shoulder straps and to do so with the desired effect.

Another helpful use of the virtually invisible straps of the present invention would be when multiple undergarments are worn under a sheer outer garment. By design the straps of brassieres, slips, and camisoles often extend across different parts of a shoulder, which can result in misalignment of straps when two or more undergarments are simultaneously worn. Under a sheer or semi-sheer outer garment, misaligned undergarment straps detract from what might otherwise be a positive fashion statement. In the alternative, if one or more of the simultaneously worn garments contained the non-shiny, transparent, and substantially invisible straps of the present invention, a single set of visible undergarment straps or the illusion of no undergarment straps at all would create a more eye-pleasing effect. The virtually invisible straps of the present invention would also be suitable for use with brassieres and other undergarments worn under clothing having cutout designs that otherwise would be in a position to expose one or more of the undergarment straps. Yet another advantageous use of the present invention would be with brassieres and other undergarments worn under loosely fitting sleeveless apparel that might otherwise allow undergarment straps to become visible when the person wearing them is active. Through use of the present invention, a person wanting to keep in step with current fashion trends that might otherwise have the undesired effect of exposing undergarment straps could do so without having to resort to the unnecessary expense of purchasing new undergarments to match the color or design of a new outer garment each time one is acquired. Further, if the material from which the present invention were made was polyurethane or a material having a texture similar to polyurethane, it would cling to the straps of other clothing and help such straps to stay in place longer under high or moderate user activity.

The prior art believed to be the most closely related to the present invention is the invention disclosed in U.S. Pat. No. 3,860,046 to Goff(1975). The Goff invention comprises a diaphanous fabric for use in brassiere straps. It is woven, but soft and smooth. It also has nylon, polyester, or polypropylene threads woven with elastic warp threads and is contemplated for use with the fancy and delicate fabrics used to manufacture brassieres. Although the Goff disclosure repeatedly mentions a delicate appearance and translucent effect, it does not teach virtual invisibility, nor does the Goff disclosure teach straps contemplated for use with outer garments as well as undergarments. In contrast, the focus of the present invention is the virtual invisibility of straps used to make a more positive fashion statement when connected to either an outer garment or an undergarment. Also, the present invention is flexible and resilient so that it is comfortable during use, however, it does not have elastic properties that would allow it to stretch and become enlarged significantly beyond its natural length and width limits. In other words, it is contemplated for the present invention to have an ability to be readily bent or twisted without permanent injury and to quickly recover its shape when deforming pressures are removed, however, it does not resist deforming by easily expanding and contracting as would be expected in materials exhibiting elastic properties. The present invention incorporates no elastic threads and the material from which it is made is not woven. Instead, it is contemplated for the present invention to comprise a non-shiny, substantially non-stretchable, and virtually transparent extruded material, such as polyurethane. Since the strap of the present invention is non-woven, it would be less visible than the Goff invention to a casual observer when directly in view. Even though the materials used to make the strap of the present invention would not have elastic properties, and would contain sufficient thickness dimension and resiliency to resist longitudinal folding, the present invention could optionally comprise a short stretchable extension inserted between one end of each strap and the garment to which it is attached to further help the strap lay in an essentially flat position over a shoulder during use. The straps of the present invention could also be permanently attached to a garment or made to be easily detached from it. Neither detachability, nor outer garment use, is mentioned in the Goff disclosure. Further, in the embodiments of the present invention where the straps are permanently attached, it is contemplated for a strip of seam binding or other similarly biased material to be stitched over the ends of the straps and the upper edge of the garment to which they are connected to reinforce the connection therebetween, improve the overall appearance of the garment, and help secure and maintain each strap in its desired position. No apparel strap is known to be similar to the present invention, nor provide all of its advantages.

SUMMARY OF INVENTION—OBJECTS AND ADVANTAGES

It is the primary object of this invention to provide a non-shiny, non-woven, non-stretchable, and substantially invisible apparel strap that can be used in undergarments worn under outer garments having very narrow straps, sheer outer garments, and loosely fitting sleeveless apparel so that the straps of the undergarments remain essentially hidden to a casual observer during use. It is also an object of this invention to provide a substantially invisible apparel strap that can also be used in outer garments to make a fashion statement. A further object of this invention is to provide a substantially invisible apparel strap which is lightweight, comfortable, aesthetically pleasing, and discrete. It is also an object of this invention to provide a substantially invisible apparel strap that can be repeatedly laundered without becoming adversely changed in character or shape during laundering or over an extended period of use. It is a further object of this invention to provide a substantially invisible apparel strap made from material that is resilient and does not easily remain folded when the person wearing it is active and subjects it to longitudinal folding forces.

As described herein, properly manufactured and used, the present invention would provide a discrete clothing strap for use in both undergarments and outer garments, including but not limited to bras, brassieres, slips, bodysuits, camisoles, nightgowns, swim suits, bikini tops, halter tops, tank tops, and formal wear. Since the strap of the present invention is non-woven and non-shiny, it would be substantially invisible and remain essentially hidden to a casual observer during use to support undergarments worn under outer garments having very narrow straps, sheer outer garments, and loosely fitting sleeveless apparel. Although at least one stretchable extension is optionally contemplated in permanently attached embodiments of the present invention to prevent twisting and allow the present invention strap to lay flat during use, the thickness dimension and width of the material employed, as well as its non-stretchable nature, would be taken into consideration so as to provide a strap that discouraged longitudinal folding during use and promoted an essentially flat positioning of the strap against the shoulder of the person wearing it at all times. The non-shiny, lightweight extruded material used in the straps of the present invention, such as polyurethane, would make them comfortable during use, aesthetically pleasing, and discrete. In permanently attached embodiments, material such as seam binding would help secure the ends of the straps in position against the garment requiring their support and improve the overall appearance of the garment. The use of seam binding and polyurethane material would allow the present invention apparel strap in permanently attached embodiments to be repeatedly laundered without becoming adversely changed in character or shape, or easily separated from the garment to which is was attached during periods of extended use.

The description herein provides preferred embodiments of the present invention but should not be construed as limiting the scope of the substantially visible apparel strap invention. For example, variations in the width and thickness of the strap material used as long as it is sufficiently thick to provide comfortable garment support and resist longitudinal folding; the type of quick-release fastener used in detachable embodiments; the length of the stretchable extension used; the material from which the stretchable extensions are made; and the front or back positioning of the stretchable extensions; other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

The preferred embodiments of the present invention offer a person wearing a garment connected thereto a discrete, virtually transparent non-shiny strap that is virtually invisible to a casual observer even when directly in view. Such invisibility can be used to hide one or more multiple straps under a sheer outer garment which otherwise would become misaligned during use, as well as providing discrete straps attached to undergarments worn beneath outer garments having very narrow straps, loosely fitting sleeveless apparel, and clothing having cutouts therein which would otherwise expose undergarment straps. For versatility of use, the straps of the present invention can either be configured for permanent attachment to a garment or structured with at least one easily manipulated, rapid-release fastener, such as quick-release fastener 22 shown in FIGS. 4 and 5, connected to each of its opposite ends. Use of the present invention straps, although not limited thereto could include attachment to bras, brassieres, slips, bodysuits, camisoles, nightgowns, swim suits, bikini tops, halter tops, tank tops, and formal wear.

Figure 1:
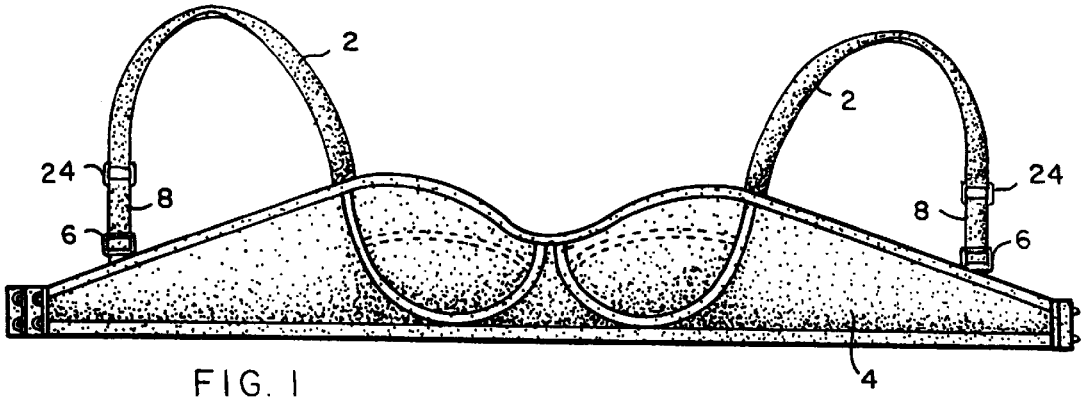
FIG. 1 is front view of a first embodiment of the straps of the present invention permanently attached to a brassiere, with a short stretchable extension connected between the rear end of each strap and the back of the brassiere.
Figure 2:
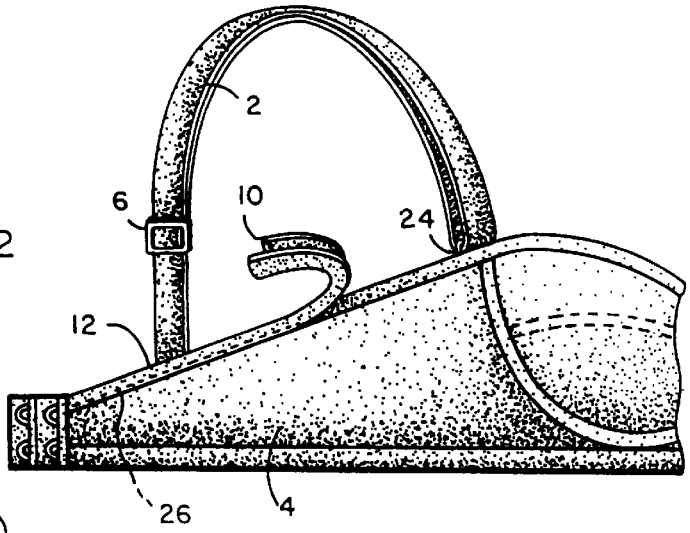
FIG. 2 is a partial front view of a second permanently attached embodiment of the present invention straps wherein no stretchable extension is placed between the ends of the straps and the brassiere, and wherein seam binding is stitched over the ends of the non-woven transparent strap and the upper edge of a brassiere to further secure the connection therebetween and improve its overall appearance.

FIG. 1 shows a first embodiment of two present invention straps 2 permanently attached to a brassiere 4. One of the opposite ends of each strap 2 is directly connected to the upper edge of the front of brassiere 4 in a location that would allow straps 2 to become extended laterally across the shoulders of a person wearing brassiere 4, such as person 16 in FIG. 3. Since it is contemplated for the material used for strap 2 to be extruded and not woven, no extra precaution would need to be taken during manufacture against unraveling or fraying of the end of strap 2 connected to the front of brassiere 4. Therefore, the end of strap 2 connected to brassiere 4 could remain flat when stitched thereto and would provide a less bulky attachment. Optionally, for extra durability in the attachment of strap 2 to brassiere 4 as well as a more finished appearance, seam binding 10, as shown in FIG. 2, or other similarly biased material can be positioned over one or both sides of a permanently attached end of strap 2 before being stitched or otherwise secured to brassiere 4. FIG. 1 also shows the other end of each strap 2 inserted through the center opening of a connector 24. Although FIG. 1 shows connector 24 having a square configuration, the shape and dimension of connector 24 is not critical. Where straps 2 are connected to undergarments, such as brassiere 4, and since in most of those applications connectors 24 would be expected to remain hidden from direct view even if a portion of strap 2 was exposed, although not shown and not limited thereto, it is contemplated that connectors 24 could be rectangular, oval, round, or have a central crossbar similar to that shown for fastener 22 in FIG. 5. In contrast, where straps 2 are connected to round configurations, or contain a central crossbar similar to that shown for fastener 22 in FIG. 5. In contrast, where straps 2 are connected to outer apparel, such as outer garment 20 in FIG. 6, connectors 24 having a square or rectangular configuration would be preferred since round connectors 24 would not provide even force distribution across the connected ends of straps 2 during use and would result in crowding together of the portion of strap 2 immediately adjacent to a round connector 24, thus preventing the entire length of the attached strap 2 from laying completely flat against the shoulder of person 16 and drawing attention to it instead of becoming virtually invisible to a casual observer. A variation of the embodiment shown in FIG. 1 could comprise connectors 24 and adjustment loops 6 of identical design, such as a round connector 24 having a central crossbar, so that only one manufacturing part is needed to perform the two separate functions of connector 24 and adjustment loop 6. Such an embodiment would facilitate inventory control and reduce manufacturing costs, unless connectors 24 without a central crossbar could be obtained at a unit cost significantly lower than the flattened rings with crossbars used in FIG. 1 to provide the adjustment loops 6. Although not shown in FIG. 1, in the first preferred embodiment it is contemplated for the end of each strap 2 inserted through a connector 24 to be folded back upon itself and stitched in place, bonded to itself, or both, to maintain a secure connection between each strap 2 to its adjacent connector 24 during use. Again, no precaution would need to be taken to prevent the cut end of strap 2 from unraveling or fraying since strap 2 would be made from extruded and not woven materials, the use of extruded materials thus also reducing the potential number of manufacturing steps. In the first preferred embodiment, and as shown in FIG. 1, it is contemplated for the width of the center opening in connector 24 to be slightly larger than the width of each strap 2 contemplated for insertion therein. However, the center opening in connector 24 could be larger than shown in FIG. 1 as long as it is not so unduly large as to allow excessive movement of strap 2 therewithin that could prevent strap 2 from laying flat across the shoulder of person 16 during use.

FIG. 1 further shows the bottom ends of two extensions 8 each permanently connected to the top surface of brassiere 4 at a similar spaced-apart distance from a different one of its ends. Although not shown FIG. 1, it is contemplated for adjustment loop 6 to have a central crossbar so that the top end of extension 8 can be inserted in an upward direction through the lower aperture in adjustment loop 6, over the central crossbar, downward through the upper aperture in adjustment loop 6, downward through the central opening in connector 24, then upward a second time through the lower aperture in adjustment loop 6 under the first part of extension 8 passing through the lower aperture in adjustment loop 6 to create a forward extension segment and a rearward extension segment, again over the central crossbar and downward a second time through the upper aperture in adjustment loop 6 under the first part of extension 8 passing through the upper aperture in adjustment loop 6, and finally becoming bonded or stitched, or both, to the rearward segment of extension 8 a short predetermined distance from adjustment loop 6. For ease of use in adjusting the length of straps 2, although not critical it is preferred that each adjustment loop 6 have top and bottom perimeters that are substantially parallel so that each strap 2 and extension 8 combination forms an untwisted circlet with brassiere 4 through which the arms of person 16 can be inserted until each strap 2 extends flat across one of the shoulders of person 16. It is contemplated for use of stretchable extension 8 to be optional, but helpful to reduce twisting of straps 2 to help them remain longitudinally unfolded and flat against the shoulder of person 16 during periods of moderate to high activity. In FIG. 1, adjustment loop 6 allows the length dimension of extension 8 to be extended and shortened to permit use of brassiere 4 by people of differing stature. However, it is also considered within the scope of the first embodiment to have adjustment loops 6 connected to straps 2 so that the length dimension of straps 2 alternatively could be extended and shortened, as in FIG. 2.

It is contemplated for the straps 2 in the first embodiment shown in FIG. 1 to be comprised of a non-shiny, non-woven, and substantially non-stretchable material that is substantially transparent, such as a thinly extruded strip of polyurethane. The stippled shading on brassiere 4 and straps 2 in FIG. 1 has been added to indicate that both straps 2 and any part of brassiere 4 could have a similar degree of transparency, although similar transparency would not be required, and all or selected parts of brassiere 4 could remain translucent or even opaque. Also, it is contemplated for the ranges of lengths, widths, and thickness for straps 2 to vary according to the application. Further, the present invention strap 2 is not limited to a single strip of thin translucent or transparent material, and it is considered within the scope of the present invention for straps 2 to also comprise multiple layers of flexible translucent or transparent extruded material, either bonded together or remaining separate from one another as appropriate to the application. The thin extruded material would be lighter in weight than either knitted or woven material and also being flexible and resilient would provide comfort during use. In addition, since straps 2 are made from non-woven material, their side edges would not be subject to fray or unraveling, and a single strip of extruded material could be used for strap 2 without having to overstitch its edges, fold and bind the edges with stitching, or provide a lengthwise side seam on the reverse side of the material used for each strap 2, after which the material for strap 2 would be turned inside-out to place the potentially frayed edges inside straps 2 during use, thus once again illustrating how the use of extruded material would simplify the manufacturing process. Further, twisting of resilient non-woven materials of the present invention would not easily occur and longitudinal fold lines would not easily be established therein. The non-woven texture would also contribute to the virtual invisibility of straps 2. Also, in embodiments in which polyurethane is used, since polyurethane is a durable material, it would hold up during use and not change shape or character after repeatedly being laundered, although in some applications hand laundering or delicate washing machine cycles might be recommended over regular washing machine cycles. Straps 2 made from polyurethane material would also tend to cling to other fabrics, helping straps 2 and the other clothing with which it comes in contact to stay in place longer during light or moderate user activity.

It is contemplated for both connectors 24 and adjustment loops 6 in the first embodiment shown in FIG. 1 to be comprised of a rigid material that is also substantially transparent, such as plastic. In the first embodiment shown in FIG. 1, stretchable extensions 8 would also comprise a stretchable material that is at least slightly translucent. Since extensions 8 would probably be made from a woven material and not expected to have the full transparency of straps 2, in most applications the length dimension of extensions 8 would be kept to a minimum to minimize the possibility of exposure of extension 8. Although connectors 24, adjustment loops 6, and extensions 8 are shown in FIG. 1 to be positioned at the end of each strap 2 connected to the back portion of brassiere 4, it is equally contemplated for any or all of the connectors 24, adjustment loops 6, and stretchable extensions 8 in the present invention to be positioned at the end of each strap 2 connected to the front portion of brassiere 4. Stretchable extensions 8 provide balance and comfort to straps 2 and minimize the tendency for longitudinal folding of straps 2 during use. It is also optionally contemplated for straps 2, stretchable extensions 8, connectors 24, and adjustment loops 6 to have UV-resistant properties to prevent premature deterioration, particularly during use with outer garments. The UV-resistant properties can be provided through use of a coating and it is contemplated that the substances so used could add a slight tint to straps 2, stretchable extensions 8, connectors 24, and adjustment loops 6. However, any such tint should be unobtrusive so that any exposed portions of straps 2, stretchable extensions 8, connectors 24, and adjustment loops 6 remain essentially hidden to a casual observer. Even though FIG. 1 shows connectors 24 and adjustment loops 6 having a preferred rectangular configuration, it is equally contemplated for connectors 24 and adjustment loops 6 to have other configurations, such as but not limited to that of a circle, oval, square, hexagon, or trapezoid in which the opposed parallel sides thereof would provide strap 2 support.

FIG. 2 shows a second embodiment of the present invention having a strap 2 that is permanently attached to brassiere 4 without stretchable extension 8 placed between one end of strap 2 and brassiere 4. FIG. 2 shows strap 2 having two superimposed segments for use in extending the usable length of strap 2 between a maximum length dimension and a minimum length dimension, a connector 24 attached to the front portion of brassiere 4, and an adjustment loop 6 near the end of strap 2 connected to the back portion of brassiere 4. Although not shown, connector 24 can be attached to brassiere 4 by seam binding 10, a piece of the same material used to make brassiere 4, a piece of material used to make straps 2, or other material. In FIG. 2, strap 2 is shown as having a single strip of material, however, this is not critical and it is equally contemplated for strap 2 to comprise more than one strip, bonded together or unbonded to make a fashion statement, and for adjustment loop 6 to be near to the end of strap 2 connected to the front portion of brassiere 4 with connector 24 attached to the back portion of brassiere 4. In addition, FIG. 2 shows a quantity of seam binding 10 or similar material being attached with stitching 26 over the ends of strap 2 and the upper edge of brassiere 4 to further secure the connection therebetween. Seam binding 10, or other similarly biased material used in place of seam binding 10 (not shown) should be flexible material that is readily laundered without a permanent or adverse change in shape or character.

Figure 3:
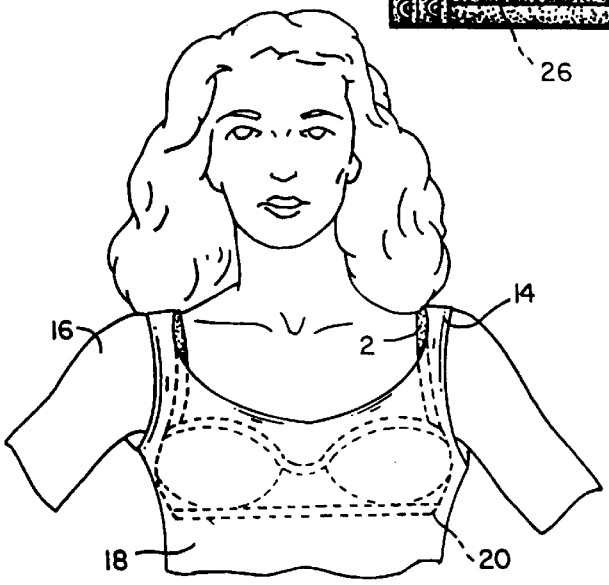
FIG. 3 is a front view of a third embodiment of the present invention straps attached to a women's undergarment, such as a swim suit top, and positioned beneath an outer garment having narrow straps.

FIG. 3 shows a third embodiment of the present invention with straps 2 permanently attached to a women's garment 20, such as a swim suit top, and positioned beneath an outer garment 18 having narrow straps 14. Even when not completely covered by narrow straps 14, since straps 2 are non-shiny, non-woven and substantially transparent they not readily viewed by a casual observer (not shown). When garment 20 is worn as an outer garment, such as is shown in FIG. 6, the nearly invisible straps 2 give garment 20 the illusion of straplessness.

Figure 4:
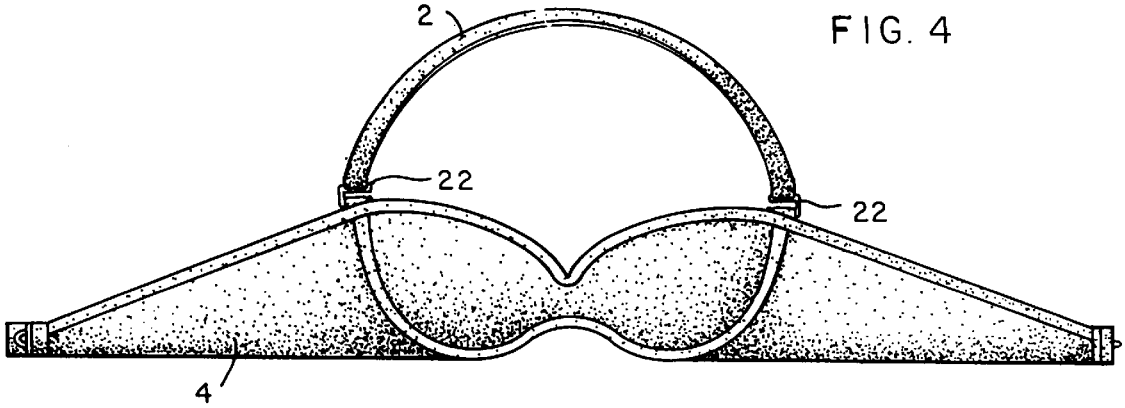
FIG. 4 is a perspective view of a fourth embodiment of the present invention straps wherein the ends of a single strap are detachably connected to a halter top.

FIG. 4 shows a fourth embodiment of the present invention straps wherein straps 2 are detachably connected to a brassiere 4 or brassiere-like garment such as a halter-top with fasteners 22. Although FIG. 4 shows one strap 2 with two attachment points to brassiere 4, it is equally considered within the scope of the present invention to have two or more detachable straps 2 attached to brassiere 4. Each strap 2 could be connected to two fasteners 22, one on each of its ends, or in the alternative connected to one fastener 22 to brassiere 4 with the other end unencumbered for tying in a knot or bow behind the neck of person 16. It is contemplated for fasteners 22 to be easily manipulated and have a readily releasable configuration so as to rapidly engage and release straps 2 from brassiere 4. Further, although FIG. 4 shows fasteners 22 permanently connected to straps 2 and readily releasable from brassiere 4, in the alternative it is also considered within the scope of the present invention for fasteners 22 to be permanently connected to brassiere 4 and readily releasable from straps 2. In addition, the configuration of fasteners 22 is not critical. Although FIG. 4 shows both fasteners 22 having a rectangular configuration, it is equally contemplated for fasteners 22 to have other configurations, such as but not limited to that of a circle, oval, square, hexagon, or trapezoid with the opposed parallel sides thereof providing strap 2 support. Although FIG. 4 shows no adjustment loop 6 connected to strap 2 to expand and shorten its length, an adjustment loop 6 could be provided so that strap 2, is readily adjustable for people of differing stature.

Figure 5:
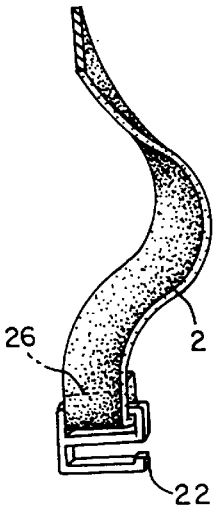
FIG. 5 is an enlarged perspective view of the fourth embodiment showing a quick-release fastener permanently attached to one end of a single layer strap having no folded edges, the fastener being configured for easy, rapid attachment and removal from a supported garment.

FIG. 5 shows an enlarged view of the fourth embodiment of strap 2 wherein a rectangular fastener 22 is permanently connected to one end of strap 2 through stitching 26. Although not shown, the end portion of strap 2 folded back on itself could also be bonded to the remaining portion of straps 2, or both stitched and bonded. Fastener 22 is configured for easy, rapid attachment and removal of strap 2 from an article of clothing, such as garment 20 in FIG. 6 or brassiere 4 in FIG. 4. It is also contemplated for fastener 22 to be made from a rigid, substantially transparent material, such as plastic. FIG. 5 shows strap 2 as single strip of extruded material wherein no side seams or end folds are needed to protect a potentially frayed or unraveled edge, such as that expected when using woven materials. Although FIG. 5 shows a strap 2 composed of a single strip of material, it is equally contemplated for strap 2 to be composed of two or more extruded strips that have been bonded together.

Figure 6:
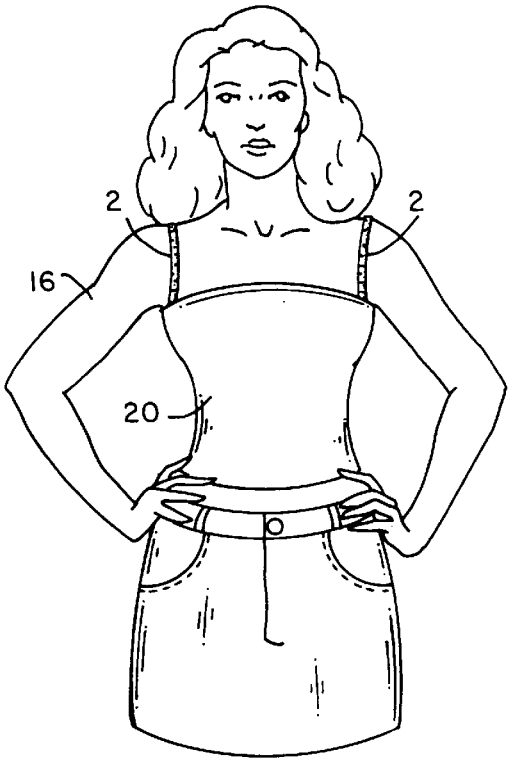
FIG. 6 is a front view of a fifth embodiment of the present invention showing its discretely visible straps attached to an outer garment to give it a strapless illusion.

FIG. 6 shows a fifth embodiment of the present invention showing its discretely visible straps attached to a woman's garment 20 that is not necessarily intended to be covered by another article of clothing, such as outer garment 18 in FIG. 3. The effect of straps 2 is to give garment 20 a strapless illusion to a casual observer (not shown). Since straps 2 are made from a flexible and resilient non-woven material, they would not easily become longitudinally creased or folded during use and would be comfortable to the person 16 wearing garment 20. The invisibility of straps 2 can be used to hide them under a sheer outer garment, such as outer garment 18 shown in FIG. 3, beneath outer garments 18 having very narrow straps 14, loosely fitting sleeveless apparel (not shown), and clothing having cutouts therein (not shown). In addition, virtually invisible straps 2 could be used to make a fashion statement or used in postoperative or rehabilitative garments (not shown) to make them appear less obtrusive.

What is claimed is:

1. An aesthetically pleasing, and discrete apparel strap for attachment to garments, including both undergarments and outer garments, and support of the garment to which it is attached across a shoulder, said apparel strap comprising:

a garment support band having opposed ends and a fully extended length dimension sufficient to span the shoulder of the largest person having a stature appropriate to wear the garment intended for attachment to said band, said band also comprising non-shiny, substantially transparent, non-woven, lightweight, flexible, resilient, but substantially non-stretchable material;

transparent adjustment means for placing said band into an infinite number of shortened configurations each having a length dimension that is less than said fully extended length dimension;

connection means for attaching said opposed ends of said band to a garment; and a short stretchable translucent extension having opposite ends, a first one of said opposite ends being connected to one of said opposed ends of said band, and wherein said connection means permanently attaches the second one of said opposite ends and the remaining one of said opposed ends of said band in spaced-apart positions from one another to upper portions of a supported garment so that when said adjustment means is optionally used to cause said band to be shortened to the proper length for laying flat against the shoulder of any user having appropriate stature to wear the garment intended for attachment to said band said apparel strap is made virtually invisible to a casual observer even when directly in view.

2. The strap of claim 1 wherein said connection means comprises at least one length of seam-binding-like material and a quantity of thread adapted for stitching, said lengths being positioned to overlay said opposed ends and the upper portion of the garment intended for band attachment, said lengths also being secured by said thread to the garment and said opposed ends.

3. The strap of claim 1 wherein said band comprises substantially transparent extruded polyurethane material.

4. The strap of claim 3 wherein said band further comprises UV-resistant properties adapted to prevent premature deterioration of said band upon exposure to sunlight.

5. The strap of claim 1 wherein said connection means detachably connects said opposed ends of said band to a garment and comprises a plurality of easily releasable fasteners, at least one of said easily releasable fasteners being permanently attached to each of said opposed ends of said band in a position to rapidly become attached to and released from a supported garment.

6. The strap of claim 5 wherein said fasteners are also made from substantially transparent material.

7. The strap of claim 1 wherein said adjustment means is made from clear plastic material and comprises the configuration of a closed loop having a central a crossbar.

8. A method for supporting both outer garments and undergarments across a shoulder in an aesthetically pleasing and discrete manner whereby the means of support is virtually invisible to a casual observer even when directly in view, said method comprising the steps of:

providing a lightweight, flexible, resilient, non-shiny, non-woven, substantially non-stretchable, and substantially transparent garment support band having opposed ends and a fully extended length dimension sufficient to span the shoulder of the largest person having a stature appropriate to wear the garment intended for attachment to said band, a short stretchable translucent extension having opposite ends, transparent adjustment means, and connection means;

attaching a first one of said opposite ends to one of said opposed ends; using said connection means for permanently attaching the second one of said opposite ends and the remaining one of said opposed ends of said band in spaced-apart positions from one another to upper portions of a supported garment so that said band will lay flat across the shoulder of a person wearing the garment; and optionally using said transparent adjustment means to shorten said band to the proper length for laying flat against the shoulder of any user having appropriate stature to wear the garment intended for attachment to said band.

9. The method of claim 8 wherein said step of providing said connection means comprises the providing of at least one length of seam-binding-like material and a quantity of thread adapted for stitching, and wherein said step of using said connection means further comprises the step of positioning said length to overlay the second one of said opposite ends of said extension and the remaining one of said opposed ends of said band, and the step of securing said length by said thread to the intended garment, the remaining one of said opposed ends, and the second one of said opposite ends.

10. The method of claim 8 wherein said step of providing said band further comprises the providing of a substantially transparent band made from extruded polyurethane material.

11. The method of claim 10 wherein said step of providing said band further comprises the providing of a band having UV-resistant properties adapted to prevent premature deterioration of said band upon exposure to sunlight.

12. The method of claim 8 wherein said step of providing said connection means further comprises the steps of providing a plurality of easily releasable fasteners, permanently attaching one of said fasteners to each of said opposed ends of said band, and using said fasteners to detachably connect said opposed ends of said band to and release said opposed ends of said band from a supported garment.

13. The method of claim 12 wherein said step of providing said fasteners further comprises the step of providing fasteners that are substantially transparent.

14. The method of claim 8 wherein said step of providing said adjustment means comprises the step of providing a closed loop having a central a crossbar made from clear plastic material.

15. The strap of claim 2 wherein said band comprises substantially transparent extruded polyurethane material.

16. The method of claim 9 wherein said step of providing said band further comprises the providing of a substantially transparent band made from extruded polyurethane material.

* * * * *